United States Patent [19]

Errichiello

[11] 4,315,642

[45] Feb. 16, 1982

[54] INTEGRALLY MOLDED COVERS AND SPINES FOR LOOSELEAF BOOKS

[76] Inventor: Dominic R. Errichiello, 389 Meadowlark Rd., Bloomingdale, Ill. 60108

[21] Appl. No.: 63,863

[22] Filed: Aug. 6, 1979

[51] Int. Cl.[3] ..... B42F 13/40

[52] U.S. Cl. ..... 281/33; 402/3; 403/73

[58] Field of Search ..... 281/1, 34, 33, 35, 36, 281/37, 49, 70, 80 P, 3, 25, 26, 29, 31, 15, 17, 19 R, 22; 402/73, 74, 3, 75, 76; 40/537, 373

[56] References Cited

U.S. PATENT DOCUMENTS

| | | | |
|---|---|---|---|
| 389,891 | 9/1888 | Kinnard | 281/37 |
| T857,037 | 12/1968 | Pardue et al. | 161/123 |
| 1,728,431 | 9/1929 | Mevi | 281/33 |
| 1,799,617 | 4/1931 | McChesney | 281/29 |
| 1,957,039 | 5/1934 | Buenger et al. | 281/33 |
| 2,256,513 | 9/1941 | Bauer | 281/33 |
| 2,544,566 | 3/1951 | Rose | 281/31 |
| 3,088,753 | 5/1963 | Sendor | 264/299 X |
| 3,132,649 | 5/1964 | Gits | 402/75 |
| 3,159,411 | 12/1964 | McKowen | 281/25 R |
| 3,168,424 | 2/1965 | Sendor | 156/244.25 X |
| 3,201,145 | 8/1965 | Libby | 281/29 |
| 3,224,792 | 12/1965 | Vernon | 281/33 |
| 3,252,461 | 5/1966 | Schade | 402/44 X |
| 3,334,920 | 8/1967 | Orth | 281/33 |
| 3,491,196 | 1/1970 | Stein | 40/537 X |
| 3,663,041 | 5/1972 | White | 281/49 X |
| 3,995,961 | 12/1976 | Dorfman | 402/38 |
| 4,001,960 | 1/1977 | Holson | 281/31 X |
| 4,011,940 | 3/1977 | Neal | 220/339 X |
| 4,073,612 | 2/1978 | Nitta | 40/373 X |
| 4,157,875 | 6/1979 | Smith | 281/35 X |

*Primary Examiner*—Paul A. Bell
*Assistant Examiner*—John S. Brown
*Attorney, Agent, or Firm*—Keil & Witherspoon

[57] ABSTRACT

One piece, molded, looseleaf books adapted to hold paper sheets with punched holes therein, said books having a spine with a longitudinal, vertical cavity in the rear, outer face, a removable, snap-in or press-in spine insert fitted in said cavity, said book optionally having a pivotable lower segment adapted to swing about a horizontal, transverse hinge to provide a diagonal leg serving as an easel-like stand for the open book, a second, longitudinal, vertical cavity in the inner face of said spine, a snap-ring assembly mounted in said second cavity, a front cover panel and a rear cover panel pivotally connected to opposite longitudinal edges of said spine by living hinges, and one or more shallow cavities in the front face of said front cover to receive graphic insert panel(s).

Still another innovation pertains to the shape of the rear, outer face of the spine. When molded, as in the present invention, this face may be planar, transversely arched or rounded either inwardly or outwardly, ribbed longitudinally or transversely, etc. Further, the front and rear cover panels may be of any desired outline, e.g., rectangular, triangular, polygonal, circular, oval, etc. simply by providing such shape in the molding die.

5 Claims, 8 Drawing Figures

INTEGRALLY MOLDED COVERS AND SPINES FOR LOOSELEAF BOOKS

BACKGROUND AND BRIEF DESCRIPTION OF THE INVENTION

This invention pertains to new innovations in looseleaf books with snap ring assemblies for holding paper sheets with holes punched therein near an edge of the sheets. The invention provides, as a first innovation, one piece moldings having front and rear cover panels integrally connected to the spine by living hinges. Another innovation involves providing a longitudinal, vertical, shallow cavity in the rear, outer face of the spine and a removable, press-in or snap-in spine insert which is press-fitted or snap-fitted in the cavity. One size and style of the integral molding of the covers and spine can serve the needs of many purchasers of the books because different legends, indicia, logos, etc. can be printed, embossed, raised, etc. on the inserts, which can be customized for each purchaser.

Optionally, a further innovation involves also the spine insert, which, when formed as a molding of a thermoplastic polymer, may have a transverse, horizontal, living hinge which allows the lower segment of the insert to swing outwardly about 20° to 40° relative to the general plane of the spine. This feature allows the lower segment to act as an easel-like stand for standing the open book at a vertically and rearwardly sloping pitch to make reading the pages, e.g., as in a cookbook, easier.

A further innovation involves the front cover panel, the front face of which preferably has one large shallow cavity or two or more smaller, shallow cavities. Thin, mating, insert panels or sheets, customized to the needs and devices of each purchaser by the printing, embossments, raised indicia, etc. on a given set of insert panels are pressed fitted, glued, heat sealed, etc. in the shallow cavity.

Still another innovation involves redesign of the snap-ring assemblies by changing the main, metal strip from a transversely arched, rounded longitudinal edge configuration, which is usually mounted on prior, known looseleaf book spines by rivets, to a transversely rectangular, three sided strip which matingly seats in a second, longitudinal shallow cavity in the front, inner face of the spine. The two, narrow, parallel longitudinal sides of the three-sided strip have means for fixedly securing the strip in the longitudinal cavity, e.g., by barbs, dovetailing and the like.

PRIOR ART

The most common style of known, looseleaf books such as three-ring notebooks consist of rectangular paperboard of cardboard sheets forming the matrices for the front and rear cover panels and a rigid, often metal strip forming the matrix for the spine, to which the snap-ring assembly is riveted or pinned. The spine and two cover panels (one on both sides) are covered with a vinyl plastic sheet or other sheet material, the segment of the sheet at the junctures of the two longitudinal edges of the spine and the respective cover panels forming the hinges by which the cover panels are pivotally connected to the spine.

These notebooks have a number of disadvantages which are avoided by the notebooks of the subject invention. First, the assembly of the components of the books involves a number of steps, even with sophisticated machinery. The paperboard or cardboard panels and the spine strip must be fed and carefully positioned before they are covered by the vinyl sheet. The latter must be wrapped over the edges of the panels and tucked or folded around two outside corners of each panel. The vinyl sheet must be smoothly adhered to one or both faces of the panel and the back of the strip. Relatively complicated and expensive machinery useful only for making books with a particular size and shape of the front and rear cover panels is required in an automated operation.

Even when covered on both sides by the plastic sheet, the paperboard or cardboard panels are moisture susceptible and often warp within a short time span. Also the plastic sheet often works loose from the spine, particularly at the ends of the spine. When a transversely curved spine is desired, a relatively expensive, transversely curved, metal strip is added to the spine structure.

Further, sharp edges and corners, particularly at the ends, of the bent and folded metal strip serving as the matrix of the spine's snap-ring assembly are exposed and can scratch skin, snag on clothing, etc. Folds and tucks in the plastic at the two outer right angles or rounded corners of the cover panels detract from the overall neat appearance of the book and sometimes work loose at the outside corners. The snap-ring assemblies require auxiliary fasteners such as pins or rivets to fasten them to the spine strip, usually having their heads exposed on the plastic covered spines. Raised lettering, indicia, symbols, logos, etc. must be cut from a matrix sheet, usually a plastic, and very carefully positioned, smoothed and adhered to the cover panel and/or the spine. Embossed lettering, indicia, etc. of good quality on the plastic covering is made difficult due to the nature of the underlying material, cardboard or paperboard in the cover panels and metal in the case of the spine.

These, and other disadvantages known to those skilled in the art, are avoided or overcome to a substantial extent by the looseleaf books of the subject invention.

Exemplary printed prior art is found in U.S. Pat. No. 3,168,424 (integral plastic sheets adhered on cover panels and spine); U.S. Pat. Nos. 3,252,461 and 3,132,649 (attachment of snap-rings to spine); U.S. Pat. No. 4,011,940 (living hinges); U.S. Pat. No. 3,201,145 (molded plastic looseleaf binders with living hinges); U.S. Pat. No. 3,995,961 (ring binder assembly mounted in longitudinal groove in spine); and U.S. Pat. No. 3,088,753 (cast plastic book covers).

PREFERRED EMBODIMENTS

Preferred forms of the invention are illustrated in the drawings wherein.

Figure 1:
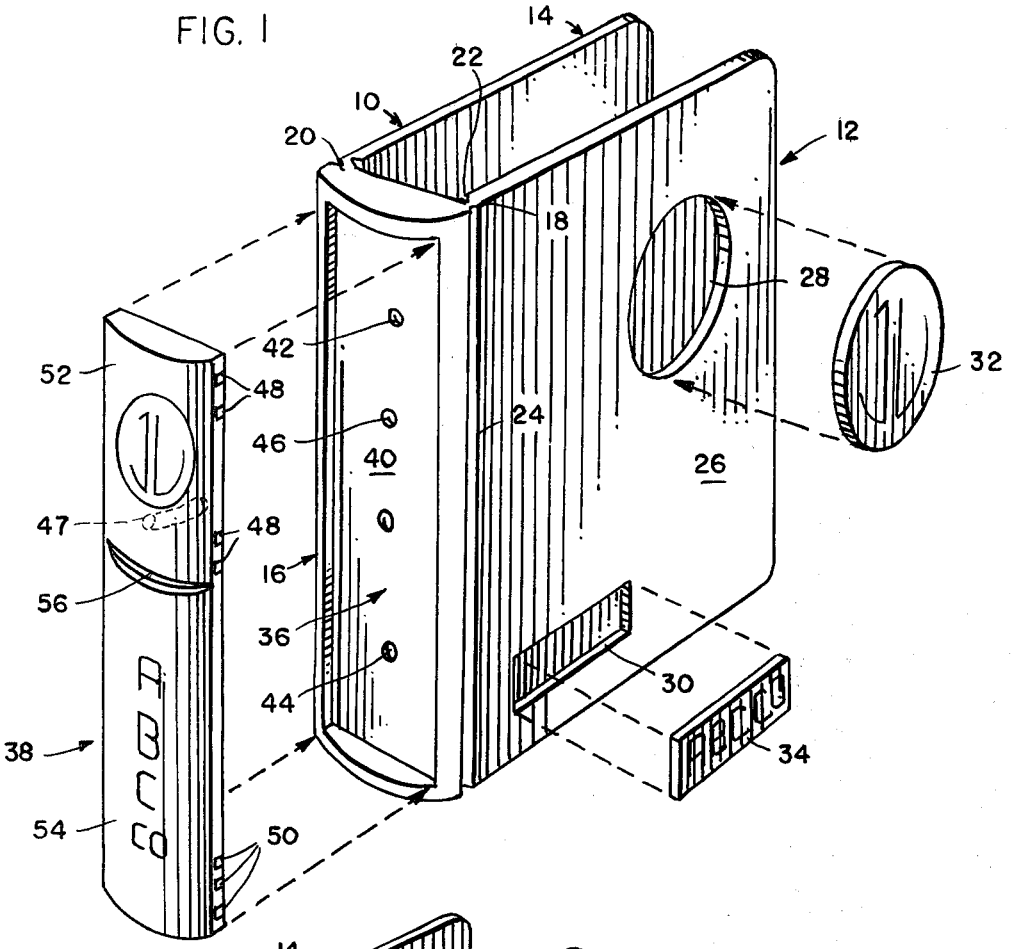
FIG. 1 is a rear, perspective, exploded view of a first embodiment of the improved, subject looseleaf books.

Referring to the drawings, the looseleaf book 10 comprises a front cover panel 12, a rear cover panel 14 and a spine 16 molded integrally from a thermoplastic polymer molding composition, preferably of a thermoplastic polymer which becomes molecularly oriented when the integrally formed hinges (weak zones) are flexed several times while the molding is still hot. Such polymers include polypropylene and polypropylene/polyethylene mixtures or copolymers. The hinge which results at the weakened zone is virtually free from cracking or tearing and is known in the art as a "living hinge".

Referring to FIG. 1, the living hinges 18 and 20 are formed at the junctures of the spine 16 and the front and rear cover panels 12 and 14 by the opposed V-notches 22 and 24 which leave a narrow neck of thermoplastic material which is the weakened zone at which the aforesaid flexing occurs, thereby integrally hinging the two cover panels 12, 14 along the opposed longitudinal edges of the spine 16.

The front face 26 of the front panel 12 has a circular, shallow cavity 28 and a rectangular, shallow cavity 30 therein. These cavities respectively receive a separately molded, thin disc insert 32 and a rectilinear, thin insert 34. Each insert bears printing, indicia, logos, designs, symbols, etc. customized to suit the needs and desires of the ultimate customer-user or customer-retailer for the looseleaf books. Thus, the basic unit consisting of the spine and the two cover panels without inserts in the caviteed front panel can be used as the basic components for customized notebooks of many divergent ultimate customers or users. Examples of the latter are manufacturers and/or distributors who use the looseleaf books as catalogs, manuals, promotions, sales aids, etc. for their goods. Similar uses by enterprises in the service fields include those of insurance companies, utilities, household and office maintenance services, instruction services, such as cooking recipes, realtors, and a host of others. In every instance, a given run of looseleaf books can be in a variety of color combinations and individually customized with particular, individualized, embossed, flat or planar lettering, designs, logos, etc. for a particular customer or user by simply changing the mold for the inserts. Similarly, snap-ring notebooks sold at stores servicing high school students, university or college students, trade school students and the like can have inserts which reflect the name, mascot, seal, or other insignia for any given institution of learning. The most in special molding die costs chargeable to each customer for individualized books would be the die costs for the inserts and for the hereinafter described spine insert, if the latter is also customized.

The spine 16 has a large, shallow, rectangular cavity 36 into which is press-fitted a rectangular, spine insert 38. The bottom wall 40 of the cavity has at least two holes 42, 44 used to mount rivets or pins which hold the snap-ring assembly on the spine. One or more additional holes 46 to receive buttons (not shown) on the spine insert 38 to mount it in cavity 36 may be provided. It is preferred, however, that the spine insert 38 be press-fitted in the cavity 36. Small, thin ribs 48 and 50 on the longitudinal edges of the spine insert preferably are employed to assure a tight press fit in the cavity.

Figure 3:
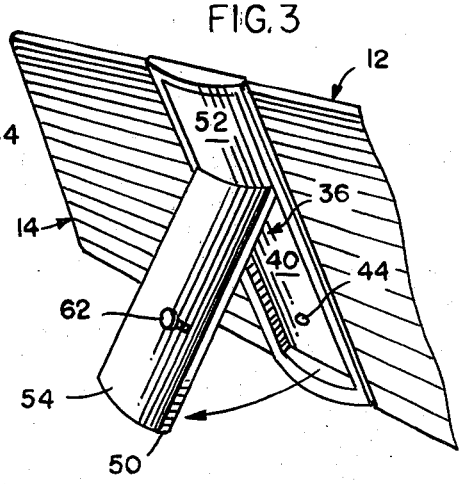
FIG. 3 is a rear perspective view of the embodiment of FIG. 2 with the book open and resting in an easily readable inclination on an easel-like stand which is part of the spine.

The spine insert may be a one piece, solid molding with or without lettering, indicia, symbols, logos, etc., thereon, or, in the illustrated embodiment, may be a molding subdivided into an upper segment 52 which is tightly fitted into the upper part of the cavity 36 and a lower segment 54, which is hingedly connected by the integral plastic hinge 56. The lower segment normally rests in the cavity 36 and is frictionally but removably held therein by the ribs 50 on opposite, lower, longitudinal edges of the lower segment 54. The latter can swing at fixed degrees (normally in the range of about 20° to 40°, preferably about 30°) away from the bottom wall 40 of the cavity until its swing is arrested when the two faces 58 and 60 of the hinge V-notch come into face-to-face contact. In this position (FIG. 3), the angulated lower segment 54 can serve as an easel-like stand or brace to hold the open book in a diagonally upstanding posture (FIG. 3). If desired, the lower segment 54 may have a knob or button 62 to grip when pivoting the segment out of the cavity 36.

Figure 2:
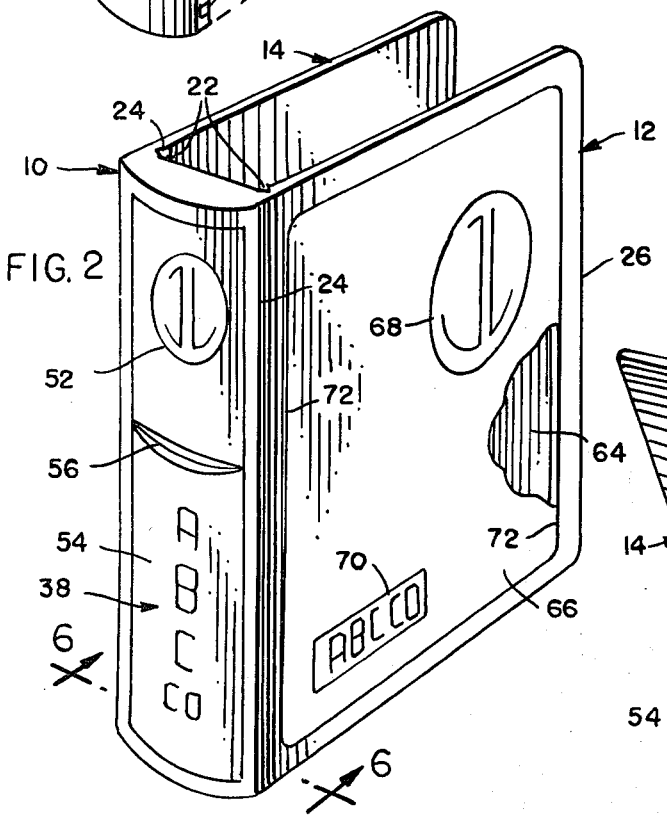
FIG. 2 is a rear, perspective view of a second embodiment of said improved books.

The embodiment of FIG. 2 is essentially the assembled version of the embodiment of FIG. 1 with one exception. The front face 26 of the front cover panel 12 has a large rectangular, shallow recess 64, shown in part by the broken out segment of the mating, molded, rectangular, thin insert panel 66. The desired lettering, indicia, symbols, logos, etc. 68 and 70 may be embossed, flat printed or raised on the face itself or may in turn be on inserts placed in cavities or holes in the insert panel 66. To mask the parting line 72 between the face 26 and insert panel 66, a thin, narrow, raised rib (not shown) may be provided around the periphery of the insert panel or the cavity.

FIGS. 1–3 show the relative ease in making a transversely arcuate (convexly rounded) rear face on the spine simply by providing for such contour in the spine and spine insert molds. No special metal strips or other auxiliary pieces are required to attain this shape. However, if desired, the rear face may be flat or even transversely concavely rounded. Ribbing or other decorative geometry may be readily obtained via the molds' contours.

Figure 4:
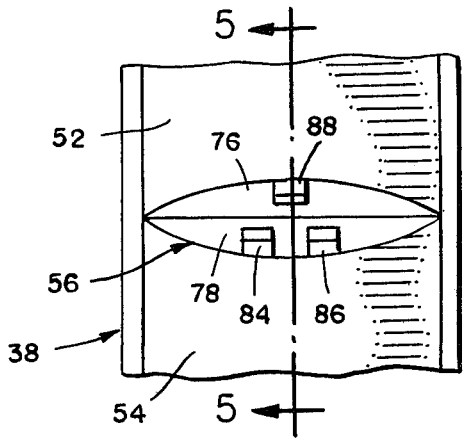
FIG. 4 is an enlarged, fragmentary front elevation of the hinge of the easel-like stand of FIGS. 2 and 3.
Figure 5:
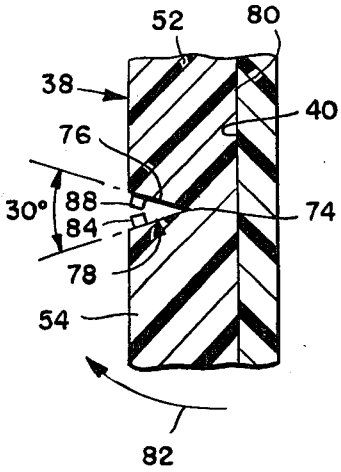
FIG. 5 is a still further enlarged, fragmentary section view taken on section plane 5—5 of FIG. 4.

As can be seen in FIGS. 4 and 5, the V-notch which forms the hinge 56 in the spine insert 38 has a straight line nadir 74 extending transversely across the full width of the spine insert 38 and parallel with the rear wall 80 of the insert. The "moon-shaped" faces 76, 78 of the V-notch lie in diagonal planes at about a 30° angle to each other. When the lower segment is pivoted in the direction of arrow 82 away from the cavity's bottom wall 40, the lower segment 54 can swing outwardly until the faces 76, 78 touch. This stops the swinging action and sets the lower segment at an angle of about 30° relative the walls 40 and 80. If desired, the lower segment can be releasably locked at the 30° angle by providing two spaced ribs or teeth 84, 86 on one face of the V-notch and one rib or tooth 88 on the other face, the ribs or teeth being spaced and dimensioned so that the sides of the tooth 88 frictionally engage the inner, opposing sides of the teeth 84, 86.

Figure 6:
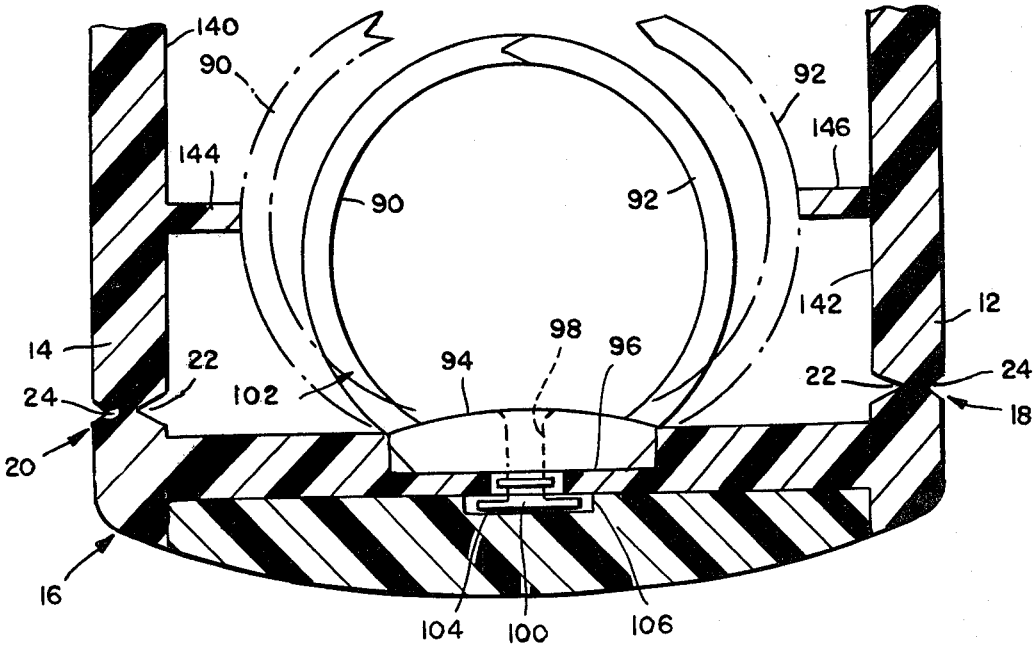
FIG. 6 is a fragmentary, section view taken on section plane 6—6 of FIG. 2.

FIG. 6 illustrates the mounting of a snap-ring assembly of the type currently in wide use in the prior art looseleaf books discussed above. The half rings 90, 92 are mounted to snap between closed position (full lines) to open position (phantom lines) and vice versa by structures well known in the art in the longitudinal, sheet metal, matrix strip 94, which has rounded walls, corners and ends to avoid as much as possible sharp edges, because these matrix strips are normally not recessed in the spine of the looseleaf book. In the subject invention, the matrix strip 94 is recessed in the longitudinal, rectangular, shallow cavity 96 in the front face of the spine. Two cylindrical sleeves or passages 98 through the center of the housing receive respectively a pin or rivet used to hold the snap-ring assembly 102 in the cavity 96. The head 104 of each pin or rivet lies in a recess or groove 106 in the rear face of the spine insert 38. Thus, the heads of the pins or rivets are hidden rather than exposed as in the usual types of prior looseleaf books.

Figure 7:
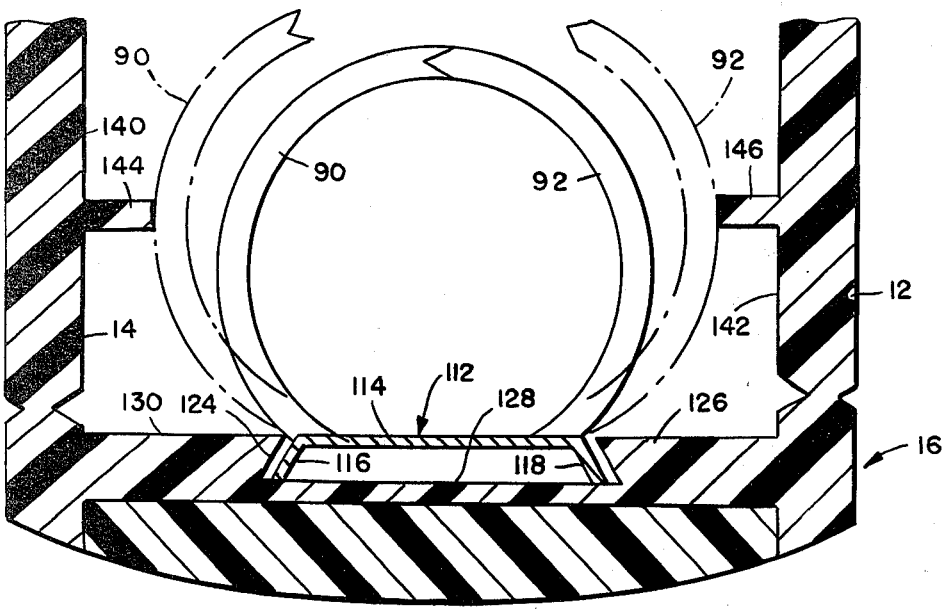
FIG. 7 is a fragmentary, isometric section view similar to FIG. 6 but with a different snap-ring assembly.
Figure 8:
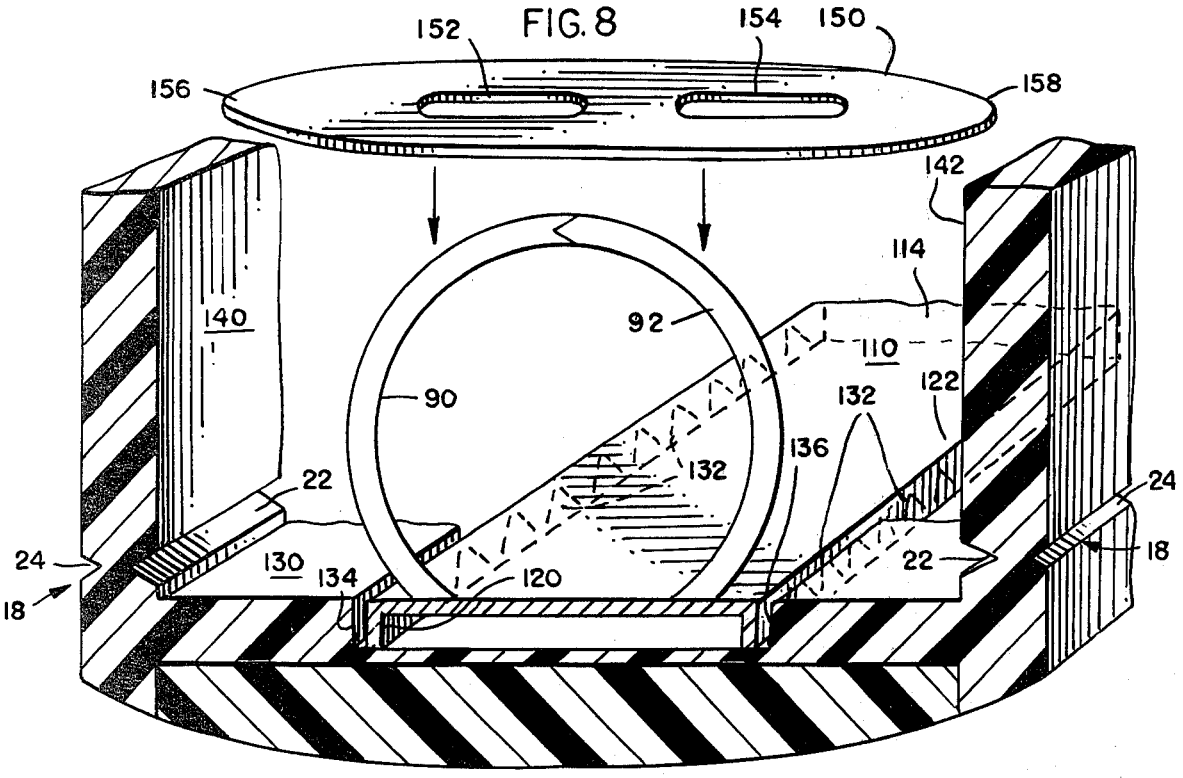
FIG. 8 is a fragmentary, section view similar to FIGS. 6 and 7 with still another snap-ring assembly.

In FIGS. 7 and 8, the matrix strip has a different shape and uses means other than rivets or pins to mount it in the longitudinal cavity in the front face of the spine. The matrix strips 110 and 112 have a flat center wall 114 and springable, diagonally flaring, side walls 116,118 (FIG. 7) or narrow side walls 120,122 at right angles to the center wall (FIG. 8). The springable, diagonally flaring walls 116,118 seat matingly against and under the diagonal side walls 124,126 of the dovetail longitudinal groove 128 in the front face 130 of the spine 16 (FIG. 7). The flat, center wall 112 of the matrix strip preferably is flush with front face 130.

In FIG. 8, the narrow side walls 120,122 have a plurality of upwardly pointed, struck-out barbs 132 which bite into the side walls 134, 136 of the rectilinear, longitudinal groove 138 in the front face 130. Most of the side wall 136 has been broken away in FIG. 8 to illustrate the barbs 132 on wall 122 in full lines. As in FIG. 7, the flat, center wall 110 in FIG. 8 is flush with the front face 130 of the spine 16.

The inside faces 140,142 of the cover panels 12,14 in FIGS. 6 and 7 have integrally molded thereon tabs or ribs 144,146 which may extend the full length of each cover panel or may be only short segments positioned opposite the snap ring segments 90,92. When the snap rings are open as shown in phantom in FIGS. 6 and 7, the tabs or ribs 144,146 engage the respective snap ring segments 90,92 as the cover panels 12,14 are pivoted toward each other into the closed position of the looseleaf books. Such engagement pushes the segments 90,92 toward each other until they snap to the closed position. Further, the tabs or ribs 144,146 engage the lowermost looseleaf sheets lying against the cover panel(s) when the book is open. As the panels swing to closed position, the tabs or ribs push the sheets upwardly toward the center of the rings.

A similar result is achieved with the thin, semi-rigid but flexible platelets 150 (FIG. 8) having a pair of elongated slots 152,154. One platelet is mounted on each snap ring by opening the snap rings and inserting ring segments 90,92 in a respective slot 152,154. The platelet drops to the matrix strip 114. The distance between its ends 156 and 158 is substantially greater than the distance between inner faces 140 and 142 when they are parallel (as in FIG. 8). When the looseleaf book is open and the snap-rings 90,92 are also open, closing of the book causes the ends 156,158 to bend and engage the open snap ring segments 90,92. This pushes the segments toward each other until they snap closed. Similarly, the platelets 150 push the looseleaf paper sheets upwardly on the rings, as the book is closed, in a similar manner to that of the tabs or ribs 144,146.

Thus, the looseleaf books of the invention can take many forms other than those described and illustrated above. It will be appreciated that the molded cover panels and spines may be any one of hundreds of colors and shades available through pigmentation and other coloring of the thermoplastic polymer molding composition. They may be a solid color or variegated. In addition to providing various indicia via the aforedescribed molded inserts for the panels, indicia, designs, lettering, etc. may be applied to the cover panel and/or spine by decals, screening, metallic plating or painting. The cover panel and spine may be smooth or textured, depending on the surface of the mold. Hot stamping of the molded cover panels and/or spine is easier to accomplish, because of their greater thickness, than is the case for the prior art, thin vinyl sheeting used to cover the panels and spine. The molded cover panels and spine are waterproof and hence not subject to warping or water deterioration. Further, the panels and/or spine may have holes of any desired shape to provide windows, optionally covered by a clear plastic sheet mounted over the respective hole. Further, the spine 16 per se and its easel-like spine insert 38 shown in FIGS. 1–5 may be attached by rivets or the like to the outer face of the spine aforedescribed, known looseleaf books to provide the stand-up feature illustrated in FIG. 3 for such known standard-type looseleaf books.

It will be appreciated from the foregoing that the looseleaf books of the invention herein can take many forms other than the preferred forms shown in the drawings and that the invention as herein claimed is not limited to the illustrated embodiments.

I claim:

1. An integrally molded book constructed of a plastic material, said book comprising:

a spine having front and rear cover panels hingedly mounted on opposite, longitudinal edges thereof;

a longitudinal cavity molded into the rear, outwardly-directed face of said spine; and a spine insert matingly fitted in said spine cavity, said spine being subdivided by an integrally molded, transverse hinge into an upper segment which is securely fitted in said spine cavity and an outwardly-rotatable lower segment adapted to serve in its outwardly rotated position as an easel-like stand for the book wherein said transverse hinge is a V-notch formed horizontally in said spine insert, the walls of said V-notch being disposed at an angle of about 20 to 40 degrees relative to each other, whereby abutment of said walls upon the outward rotation of said lower insert segment limits said outward rotation to an arc of about the combination of said angles.

2. A book as claimed in claim 1 wherein the walls of said V-notch have releasably interfitting means for holding said lower segment in its outwardly rotated position.

3. A book as claimed in claim 2 wherein said interfitting means are projections formed on the respective walls of said V-notch, said projections mechanically interlocking when said walls approach each other as said lower segment is outwardly rotated.

4. A book as claimed in claim 1 wherein said front and rear cover panels are hingedly mounted on said spine by means of living hinges.

5. A book as claimed in claim 1 wherein said upper and lower spine segments are hingedly secured to one another by means of a living hinge.

* * * * *